US006022172A

United States Patent [19]

Siyaj

[11] Patent Number: 6,022,172

[45] Date of Patent: Feb. 8, 2000

[54] REUSABLE PORTABLE FLEXIBLE FILLABLE BARRIER AND METHOD OF APPLICATION THEREOF

[76] Inventor: Jamal Mustafa Siyaj, 2448-B Meadowlark Way, Plainfield, Ind. 46168

[21] Appl. No.: 08/889,650

[22] Filed: Jul. 8, 1997

[51] Int. Cl.[7] ..... E02B 7/14

[52] U.S. Cl. ..... 405/110; 405/111

[58] Field of Search ..... 405/114, 115, 405/111, 110, 91, 21, 107, 52

[56] References Cited

U.S. PATENT DOCUMENTS

| | | | |
|---|---|---|---|
| 4,121,389 | 10/1978 | Ptaszek | 52/2.17 |
| 4,216,796 | 8/1980 | Gastrock | 137/571 |
| 4,383,564 | 5/1983 | Hoir | 383/66 |
| 4,650,368 | 3/1987 | Bayer | 405/111 |
| 4,807,405 | 2/1989 | Borgquist | 52/2.18 |
| 4,898,306 | 2/1990 | Pardes | 222/206 |
| 4,921,373 | 5/1990 | Coffey | 405/115 |
| 4,981,392 | 1/1991 | Taylor | 405/115 |
| 5,040,919 | 8/1991 | Hendrix | 405/115 |
| 5,429,437 | 7/1995 | Shaw et al. | 383/33 |
| 5,632,573 | 5/1997 | Baker | 405/111 |

*Primary Examiner*—David Bagnell
*Assistant Examiner*—Sunil Singh
*Attorney, Agent, or Firm*—Maryam Bani-Jamali; Butler & Binion

[57] ABSTRACT

The present invention relates to portable flexible fillable barriers that are used to restrain the flow of fluids and to serve as reservoirs, containers (for solids as well) and embankments. The portable flexible fillable barrier is collapsible upon itself into a smaller size, facilitating storage and transportation, and is self-opening from the collapsed state. The portable flexible fillable barrier has a flexible fillable wall comprising an upper portion, a lower portion, a top end, a bottom end, several sides, a number of openings and a supporting frame that has inner structural cells with cell openings and an enclosing flexible membrane. Numerous portable flexible fillable barriers may share a fluid path formed by holes in shared side walls or formed by tubes leading from one portable flexible fillable barrier to another. The enclosing flexible membrane (that consists of impermeable material) prevents any flow of the enclosed fluid, via the impermeable material, out of the inner structural cells, causing the flexible fillable wall to expand. The method of application of the portable flexible fillable barrier is also discussed.

23 Claims, 7 Drawing Sheets

REUSABLE PORTABLE FLEXIBLE FILLABLE BARRIER AND METHOD OF APPLICATION THEREOF

BACKGROUND OF THE INVENTION

1. Field of the Invention

This invention relates to a reusable portable flexible fillable barrier that is especially suited for controlling free flow of fluids and that uses a flexible fillable wall as a basic element. The method of application of the portable flexible fillable barrier is also discussed.

2. Description of the Prior Art

A wide variety of inventions and innovations in the past have been related to conservation and preservation of water, a necessity of life. In some areas of the world, water is a rarity. In contrast, in some areas continuous heavy rains can overwhelm the water containment and barrier systems, causing flooding situations that can result in huge losses of life and property. Although some areas may have sufficient yearly rainfall, a lack of balance in the availability of water throughout the year creates the need to collect and store water during the rainy seasons for use in the dry seasons.

For many years, sandbags have been commonly used to construct a temporary dam, barrier or wall for containing and restraining flood waters. Massive quantities of filler material and intensive manpower are required for the application of sandbags. Filled sandbags must be stored or sand must be kept in close proximity or carried to the flood site for the filling of the bags. Any other material that can satisfy the task of sand in sandbags may also be used. Once the bags are filled, they must be transported from the site of filling the bags to where they are to be used. Since filling the bags and transporting the sandbags requires a considerable amount of time and labor, the rate of application of sandbags to restrain the flood waters may be very slow depending upon the number of individuals available. Sandbags also absorb the fluid which they contain and, as a result, can retain pollutants or other harmful or toxic substances.

The need to control, balance and manage the water supply and resources more efficiently and safely, has resulted in the development of many devices including collapsible, self-expanding fluid containers. In most of such collapsible, self-expanding fluid containers, a flexible, resilient structural member provides a static configuration to the device but can be collapsed to create a compact size for storage purposes. However, the portability and ease of assemblage of the existing collapsible, self-expanding fluid containers leave much to be desired.

Many existing collapsible, self-expanding fluid containers may also be used for containment of other fluids, such as oil and hazardous fluids. However, most existing containers require excessive handling in being set up, endangering the individuals who are in the proximity of the container.

As examples, several patents that have been issued in the past decade and are focused on numerous devices that are used for flood control follow:

Coffey, U.S. Pat. No. 4,921,373, issued on May 1, 1990, patents a barrier for containing floods and comprising a flexible container with a high point vent, a low point drain and a frame that has a plurality of legs and that supports the flexible container. Although a series of individual frames and flexible containers can be interlocked to form a barrier which can be used as a dam structure, labor is involved in setting up the supports and fastening them in place and in disassembling the supports. In addition, the legs of the frame are solid and, thus, take up space and have weight that has to be transported.

Hendrix, U.S. Pat. No. 5,040,919, issued on Aug. 20, 1991, patents a device for controlling floods or spilled fluids. The device comprises an elongated, triangular flexible container, a spout for flow of water into the container, a front flap for anchoring the container and end pieces for sealing the end of the container. These devices are more easily and more efficiently transported and installed than other existing related inventions. However, these devices cannot be readily attached to one another to form a system, with a capacity that can be adjusted and varied without creating any disconnections in the liquid flow, in which the collected liquid passes continually from within one device into another device.

Bayer, U.S. Pat. No. 4,650,358, issued on Mar. 17, 1987, patents a flood water containment bag constructed of lightweight, inexpensive, porous, water-absorbing material. By absorbing water, the bag increases in weight and volume and expands to form a water barrier. Horizontally-arranged bags can be attached to one another by fastening strips to the top and bottom surfaces of the bags. Although the bags are more easily transported and installed and are less expensive than other related patented inventions, drying, storage and disposal of the bags after absorption of water may create problems, the permeability of the bags may result in some leakage.

The above-listed patents and many other similar inventions have been developed, some of which still exist in the market. However, the conventional procedure still being used is the application of sandbags by manually placing the sandbags to form a barrier. The sandbags are still either filled on the flood site or transported in filled condition on trucks to the flood site. Even if the sandbags are prefilled and transported to the site of use, the sandbags are ultimately being manually lifted and placed in position to form the desired barrier to effectively block or contain flood waters. Furthermore, sandbags often fail to contain flood waters and are washed away. Also, the amount of water that leaks through the sandbags renders the sandbags ineffective as an acceptable total and reliable solution.

The patents and innovations in the market have been usually oriented towards developing individual containers that have a set capacity for collecting a fluid and that mostly lack any flexibility in the amount of collected fluid. In addition, most of the past inventions are constructed of relatively heavy and expensive components, are relatively expensive and time-consuming to manufacture, are not simply and efficiently transported and installed, necessitate numerous man-hours of labor for storage, transportation, installation and disassembly and require a large amount of space for storage and transportation. Thus, even if any past or existing inventions have had been or are presently being marketed, such inventions have had a low efficiency of performance due to some of the following features: relatively expensive, difficult and time-consuming production, storage, transportation, installation, disassembly and after-use handling. The goal of this invention is to provide a reliable, safe and efficient flood containment device. This invention strives towards lowering the costs of manufacture and of material needed for the manufacture of the system, simplifying and increasing the efficiency of transportation and installation of the system, decreasing the required man-hours of labor, particularly for storage, transportation, installation and disassembly, of the system, minimizing the required amount of contact of an individual with the collectible fluid during installation and disassembly of the system and decreasing the amount of space needed for storage and transportation of the system.

SUMMARY OF THE INVENTION

A primary object of the invention is to devise a portable flexible fillable barrier that requires a decreased number of man-hours of labor for transportation, installation, disassembly and storage of the barrier.

Another object of this invention is to devise a portable flexible fillable barrier that is lightweight and conforms with irregular and rough terrain, but has sufficient structural rigidity.

An additional object of this invention is to devise a portable flexible fillable barrier for controlling, collecting, storing and, when desired, disposing of flood water, hazardous fluids and other fluids and for storing solid material when the barrier serves as a container for solids.

Another object of this invention is to devise a portable flexible fillable barrier that is reusable, that can be easily cleaned and that can be stored and transported in a small space.

Yet another object of this invention is to devise a portable flexible fillable barrier that self-opens from a collapsed storage position and that uses the collectible fluid, as opposed to an aggregate material such as sand, to open.

Still another object of this invention is to provide a portable flexible fillable barrier that minimizes the required amount of contact of an individual with the collectible fluid during installation and disassembly of the portable flexible fillable barrier.

A final object of this invention is to devise a collapsible container that can be easily and economically manufactured.

Additional objects and advantages of the invention will be set forth in part in a detailed description which follows, and in part will be obvious from the description, or may be learned by practice of the invention.

The present invention relates to reusable portable flexible fillable barriers that are used to restrain the flow of fluids, such as water and oil, and to serve as reservoirs, containers (for solids as well) and embankments. The portable flexible fillable barrier is collapsible upon itself into a smaller size, facilitating storage and transportation, and is self-opening from the collapsed state to an open, rigid state during application. The portable flexible fillable barrier has flexible fillable walls comprising an upper portion, a lower portion, a top end, a bottom end, several sides, a number of openings in the flexible fillable walls and a supporting frame. The supporting frame comprises interconnected inner structural cells, that include cell openings, and an enclosing flexible membrane, that encloses the inner structural cells. The inner structural cells may be constructed of fluid-absorbent materials and enable the inflow, but prevent the outflow, of the fluid. When the fluid penetrates the inner structural cells, the inner structural cells enclose the fluid and cause the flexible fillable wall to expand in volume. Numerous portable flexible fillable barriers may share a fluid path formed by holes in shared flexible fillable side walls or formed by tubes leading from one portable flexible fillable barrier to another. The method of application of the portable flexible fillable barrier is also described.

It is to be understood that the descriptions of this invention are exemplary and explanatory, but are not restrictive, of the invention. Other objects and advantages of this invention will become apparent from the following specification and from any accompanying charts, tables, examples and drawings.

BRIEF DESCRIPTION OF CHARTS, TABLES, EXAMPLES AND DRAWINGS

Any accompanying charts, tables, examples and drawings which are incorporated in and constitute a part of this specification, illustrate examples of preferred embodiments of the invention and, along with the description, serve to explain the principles of the invention.

DETAILED DESCRIPTION OF THE PREFERRED EMBODIMENT

Preferred embodiments of the present invention are illustrated in any charts, tables, examples and drawings that are included. It should be emphasized that the preferred embodiments are not intended to place any limitations upon the invention.

Figure 1A:
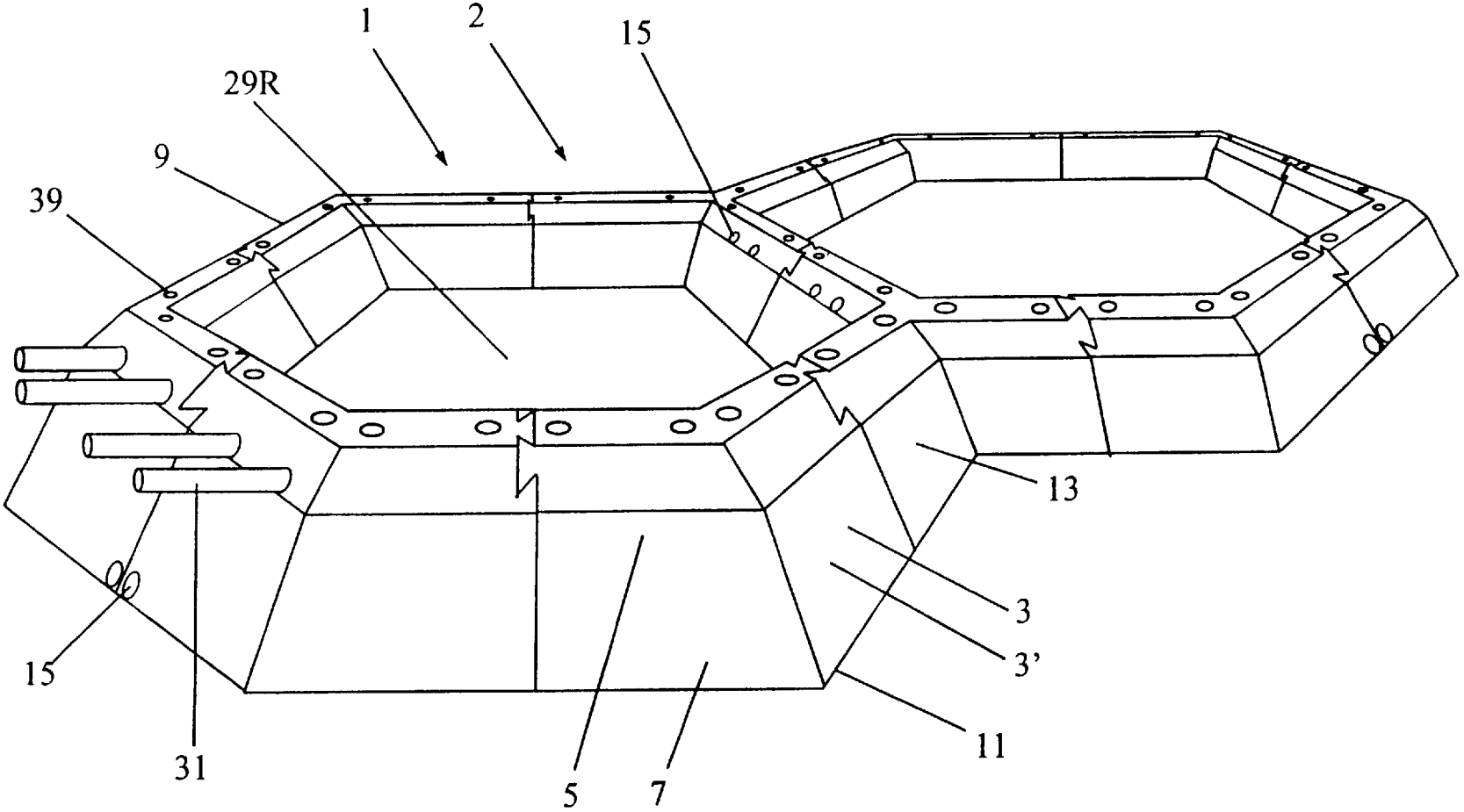
FIG. 1A shows a perspective view of two portable flexible fillable barriers that serve as reservoirs, that each comprise a number of flexible fillable walls and that share a flexible fillable side wall.
Figure 1B:
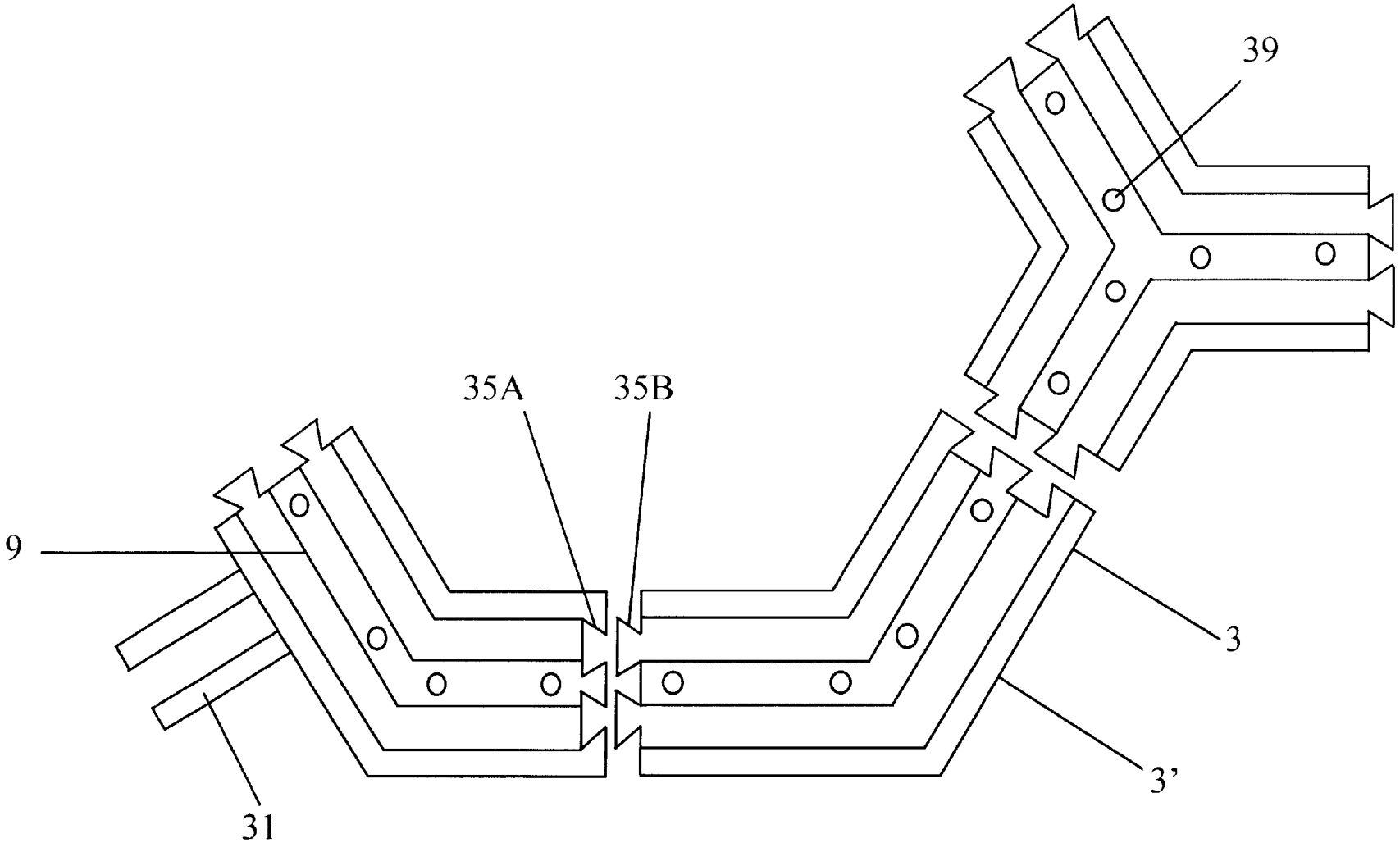
FIG. 1B shows a partial, exploded, top view of FIG. 1A, showing connections between the flexible fillable walls of FIG. 1A.
Figure 2A:
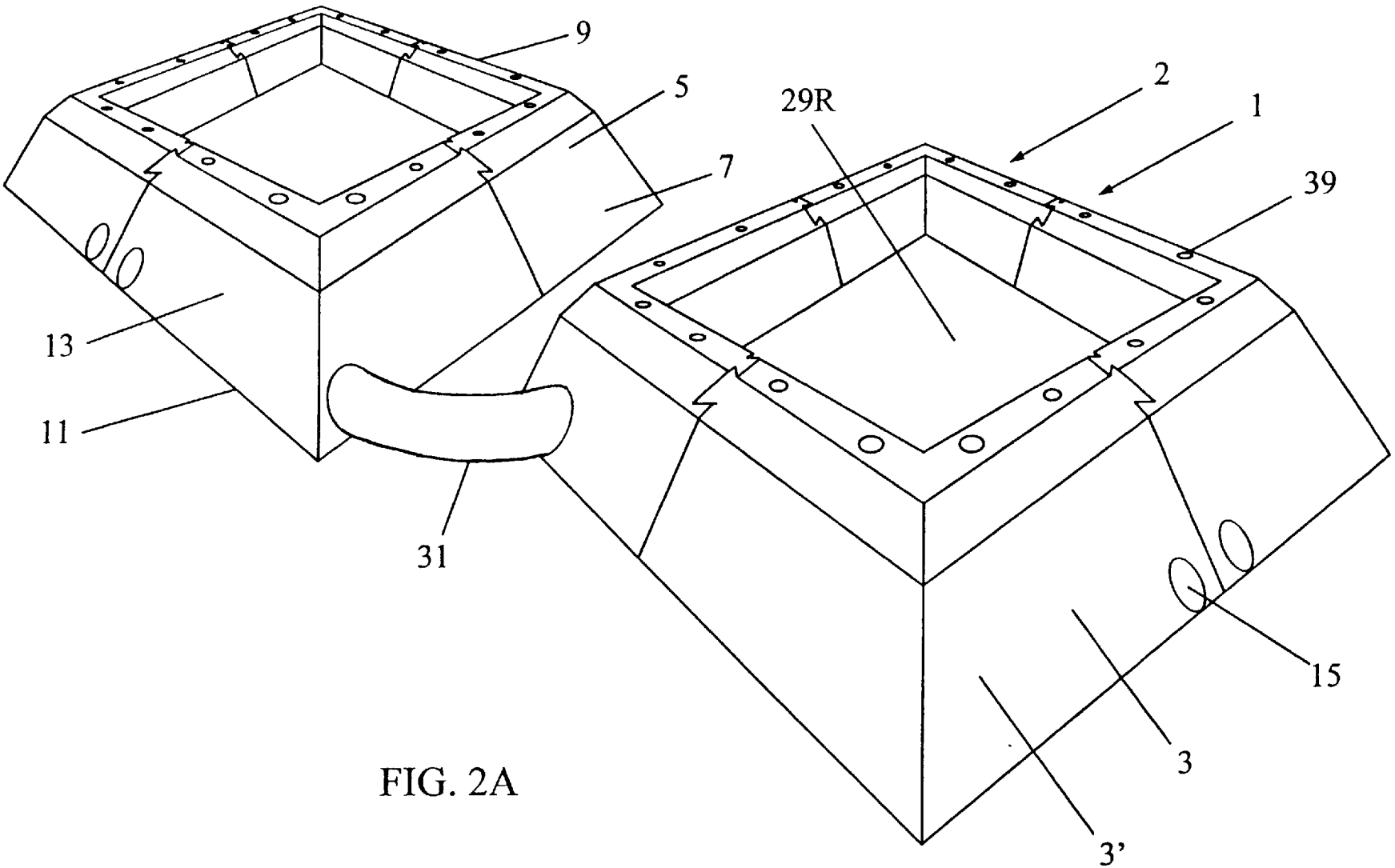
FIG. 2A shows a perspective view of two portable flexible fillable barriers that serve as reservoirs, that each comprise a number of flexible fillable walls and that are connected by a tube.
Figure 2B:
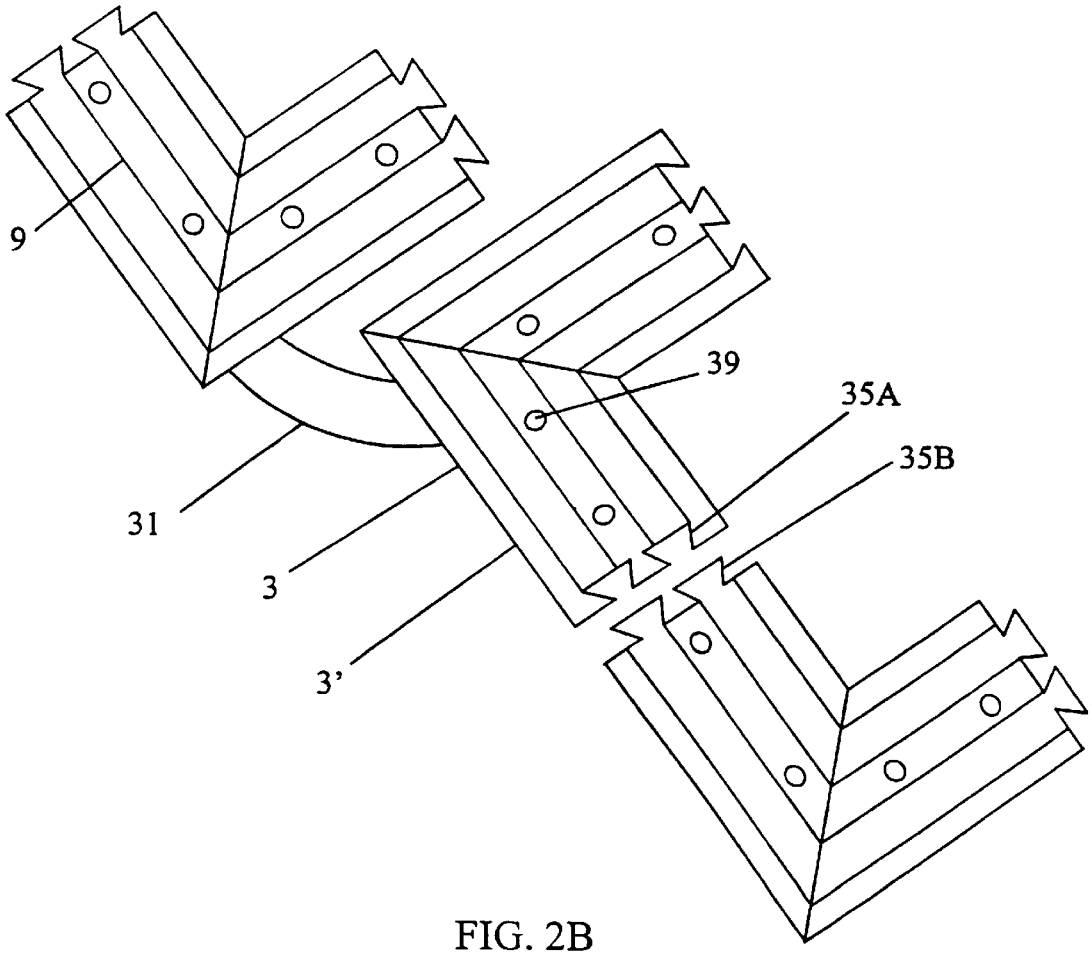
FIG. 2B shows a partial, exploded, top view of FIG. 2A.
Figure 3B:
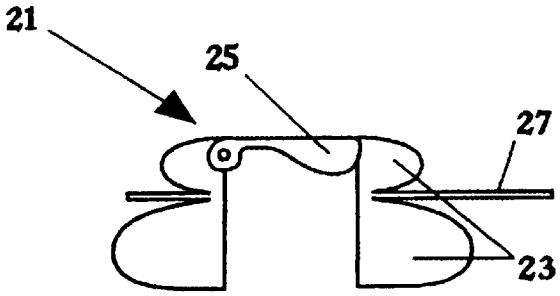
FIG. 3B shows an expanded view of a floating device used in the supporting frame of FIG. 3A.
Figure 3C:
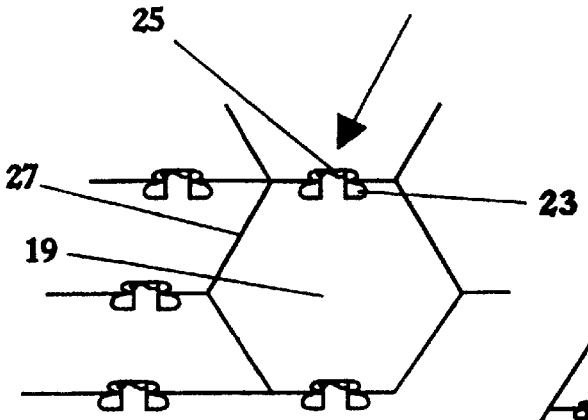
FIG. 3C shows a partial, expanded view of the supporting frame of FIG. 3A.
Figure 3A:
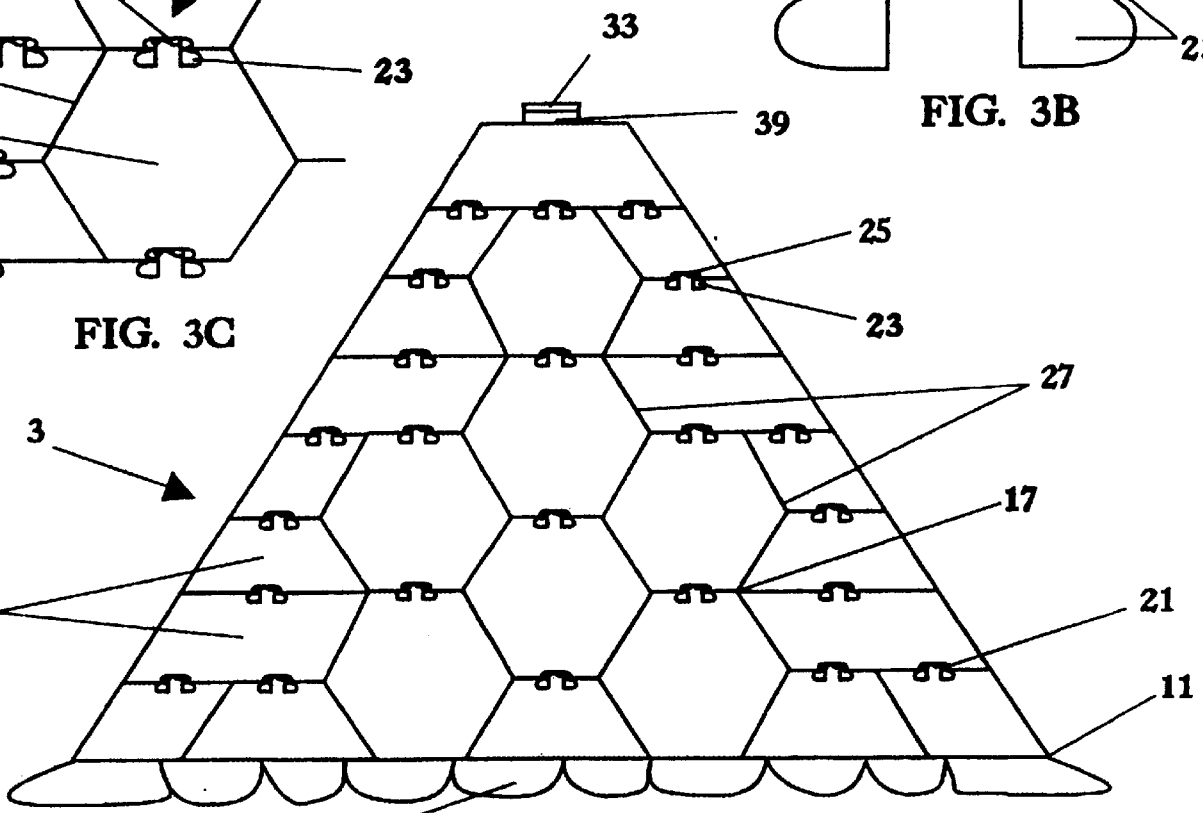
FIG. 3A shows a cross-sectional view of a supporting frame that is used for constructing a portable flexible fillable barrier.

The present invention provides a reusable portable flexible fillable barrier 1, and the method of application thereof, especially suited for use in controlling the free flow of fluids, particularly flood water. Portable flexible fillable barriers 1 may be each designed and customized for a particular type of area and application. The topography of the area, for example in terms of water flow, available adjacent fields and bodies of water and available natural or man-made dikes and retaining walls, is studied in order to customize pre-built portable flexible fillable barriers 1. Knowing that floods in each area usually follow repeated patterns, the customized portable flexible fillable barriers 1 are each positioned at its corresponding location, providing an increased amount of efficiency, safety and water storage capacity. In order to prevent flood fluid from flowing over the portable flexible fillable barrier 1, each portable flexible fillable barrier 1 is preferably filled to a level at or above the level of the flood fluid. The collected water is safely and efficiently released afterwards. Some applications of the present invention are as water levies, water dikes, water reservoirs, above ground water wells, water canals, channels, water tunnels and storage tanks. Although water is used in describing the preferred embodiments of the present invention, there is no limitation to the types of fluids that could be captured by the portable flexible fillable barrier 1. The invention includes various forms of the portable flexible fillable barriers 1 (e.g. of different shapes, structures, sizes and components) that are used to control the flow of fluids. A cross-sectional view of the portable flexible fillable barrier 1 may have various shapes (e.g. triangular, quadrilateral, semi-circular, half-geodesic, semi-hexagonal, semi-octagonal etc.). A number of the portable flexible fillable barriers 1 may be connected to one another by using connecting tubes 31 which lead from and connect one portable flexible fillable barrier 1 to another following portable flexible fillable barrier 1. (Please refer to FIGS. 2A and 2B.) In another version, one portable flexible fillable barrier 1 may share one side wall 3' with the adjacent portable flexible fillable barrier 1. (Please refer to FIGS. 1A and 1B.) There is no limit to the number of portable flexible fillable barriers 1 that may be connected to one another, enabling the formation of a chain of barriers suited for various conditions.

A basic element of the various versions of the portable flexible fillable barrier 1 is a flexible fillable wall 3 which has various forms (e.g. shapes, structures, sizes and components). The flexible fillable wall 3 comprises an upper portion 5, a lower portion 7, a top end 9, a bottom end 11, several sides 13, a number of openings 39 in the flexible fillable walls 3 and a supporting frame 17 that has interconnected inner structural cells 19 with cell openings 21 and an enclosing flexible membrane 27. (Please refer to FIGS. 1A, 1B, 3A, 3B and 3C.) Any number of openings 39 in the flexible fillable walls 3 that serve as entrances into the portable flexible fillable barrier 1 may be open or closed at any time. Caps 33 may be used for each opening 39 at all times for closing the flexible fillable wall 3.

Figure 6A:
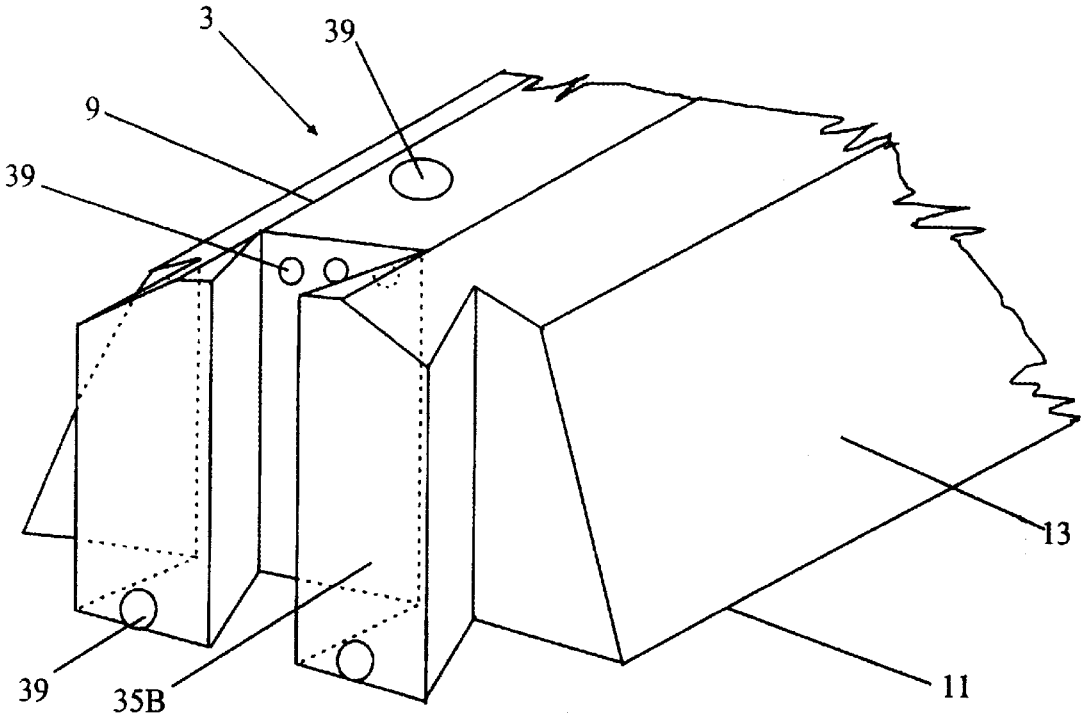
FIG. 6A shows a partial, perspective view of a flexible fillable wall with finger-like interconnecting edges, when the flexible fillable wall is filled with fluid.
Figure 6B:
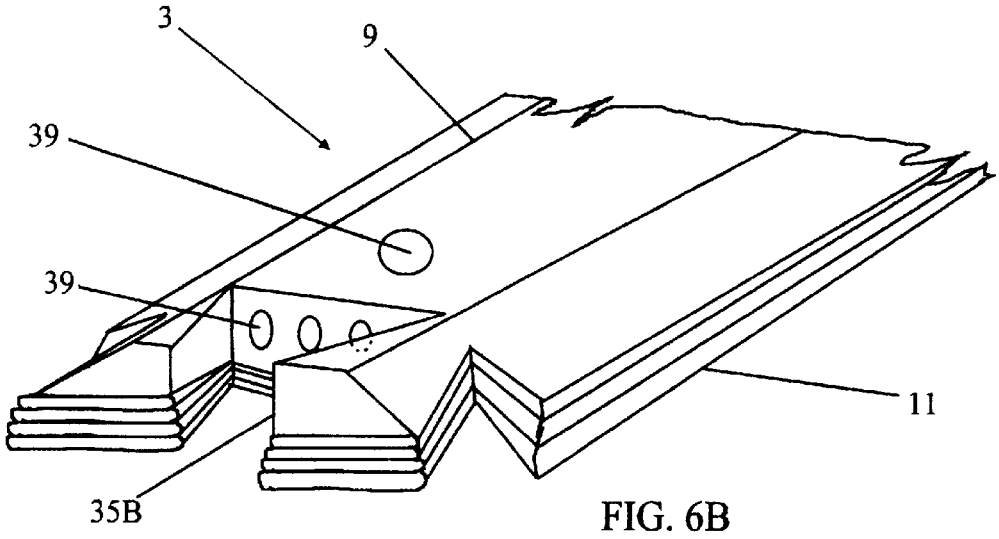
FIG. 6B shows a partial, perspective view of the flexible fillable wall of FIG. 6A, when the fluid has been removed from the flexible fillable wall.

The flexible fillable wall 3 is a basis in developing and is combined with some objects for forming various barrier structures that have different applications. Flexible fillable walls 3 form either one portable flexible fillable barrier 1 or numerous interconnected portable flexible fillable barriers 1. Strong attachments, such as latches, are used to connect flexible fillable walls 3 to one another. In a preferred embodiment, the attachment comprises finger-like interconnecting edges 35A on one side 13 of the flexible fillable wall 3 and complementary finger-like interconnecting edges 35B on the opposite side 13 of the flexible fillable wall 3. (Please refer to FIGS. 1B and 6A.) The finger-like interconnecting edges 35A on one side 13 of the flexible fillable wall 3 fit into and interlock with the complementary finger-like interconnecting edges 35B of the opposite side 13 of the neighboring flexible fillable wall 3. The finger-like interconnecting edges 35A,35B of neighboring flexible fillable walls 3 are interlocked when the portable flexible fillable barrier 1 is set up. As the fluid is filling up the flexible fillable walls 3, the finger-like interconnecting edges 35A,35B are undergoing a three-dimensional expansion as well, resulting in an increasingly stronger attachment between the neighboring flexible fillable walls 3. (Please compare FIGS. 1A and 1B with FIGS. 6A and 6B.) The number of openings 39 in the sides 13, having the finger-like interconnecting edges 35A, 35B are connected to form a fluid path between neighboring flexible fillable walls 3.

Flexible fillable walls 3 consist of numerous, interconnected inner structural cells 19. (Please refer to FIG. 3A.) The inner structural cells 19 combinedly form the overall shapes of the flexible fillable walls 3. The inner structural cells 19 may have various shapes. For example, cross-sectional views of the inner structural cells 19 may be rectangular, hexagonal, triangular, elliptical, circular, semi-circular etc. In a preferred embodiment, the inner structural cells 19 are in a pyramidal, cubical, spherical or geodesic shape. The inner structural cells 19, which may be hollow or may consist of foam-like porous material, are each enclosed by and may be attached to an enclosing flexible membrane 27. (Please refer to FIGS. 3A, 3B and 3C.) A coating, applied to the outside surface of the inner structural cell 19, may serve as the enclosing flexible membrane 27 of the foam-like porous material. The enclosing flexible membrane 27 of the inner structural cells 19, that are attached to each other preferably in a honeycomb- or geodesic-like fashion, is an essential component of the supporting frame 17. The enclosing flexible membrane 27 consists of a combination of rigid and flexible material. Although a controlled inflow and outflow of the enclosed fluid is allowed between the inner structural cells 19, the enclosing flexible membrane 27 (that consists of impermeable material) prevents any flow of the enclosed fluid via the impermeable material out of the inner structural cells 19. The fluid that enters the flexible fillable wall 3 is essentially held by the enclosing flexible membrane 27. The foam-like porous material is flexible and strong enough to prevent a rupture, while allowing the fluid to seep out of the inner structural cells 19 in the case of a cut or a relatively small damage in the enclosing flexible membrane 27. The movement of the fluid is, thus, controlled by and is restricted by the density of the foam-like porous material. The foam-like porous material is preferably rubberized, chemical-resistant and wear-resistant, soaks up, traps and holds the fluid and adds to the structural integrity of the inner structural cells 19, of the flexible fillable walls 3 and of the portable flexible fillable barriers 1. The coating is preferably composed of a fluid impermeable material that has good chemical resistance.

In a preferred embodiment of the invention, the inner structural cells 19 of the flexible fillable walls 3 are in a tubular form. The tubular inner structural cells 19 may be attached together in numerous different ways. The tubular inner structural cells 19 may be positioned horizontally or normally to the ground position. If positioned horizontally, the tubular inner structural cells 19 are placed long-ways next to each other.

In another preferred embodiment of the invention, the inner structural cells 19 of the flexible fillable walls 3 are used in a planar form. The planar inner structural cells 19 may be attached together in numerous different ways as well. The planar inner structural cells 19 may be positioned normally and long-ways to the ground position. Whether used in a planar form, tubular form or other applicable forms, the various inner structural cells 19 have similar basic features and characteristics, with variations being made to enhance the strength, fluid flow and safety features of the inner structural cells 19.

The flexible fillable wall 3 exhibits substantial strength when holding flowing substances. The enclosed fluid usually enters the flexible fillable wall 3, and the inner structural cells 19, through the number of openings 39 in the flexible fillable wall 3 and is trapped in the inner structural cells 19. The entrapped fluid becomes an essential component of the inner structural cells 19 and adds to the structural weight, integrity and strength of the inner structural cells 19, of the flexible fillable walls 3 and of the overall structure of the portable flexible fillable barriers 1. In a preferred embodiment, the inner structural cells 19 consist of light-weight, inexpensive porous materials that have a quantity of water absorbent material and increase substantially in volume and weight upon absorbing water. The ratio of the increase in weight to the increase in volume of the porous material has to be large enough to ensure that the fluid outside of the portable flexible fillable barrier 1 does not tend to float the portable flexible fillable barrier 1.

The flexible fillable walls 3 of each portable flexible fillable barrier 1 are filled up by pouring or pumping fluid into the inner structural cells 19 via the number of openings 39 of each flexible fillable wall 3. When desired, the fluid is pumped into or towards the portable flexible fillable barrier 1. For example, flood water can be pumped from a rising river, stream or other body of water into or toward the portable flexible fillable barrier 1. The top end 9 of the flexible fillable wall 3 is being pulled up automatically while the fluid is flowing into the flexible fillable wall 3. In a preferred embodiment, the inner structural cells 19 have controlled-access one-directional cell openings 21 which are each equipped with a floating device 23. (Please refer to FIGS. 3A, 3B and 3C.) The floating device 23 comprises a lever-like section 25 and is attached to the inner structural cells 19. Except for an uppermost and a lowermost group of inner structural cells 19, each controlled-access one-directional cell opening 21 is positioned in a bottom part of an upper inner structural cell 19 and in a top part of a neighboring lower inner structural cell 19. Before the inner structural cell 19 is filled with fluid, the lever-like section 25 of the floating device 23 is positioned such that the controlled-access one-directional cell opening 21 is not closed and the fluid may flow into the inner structural cell 19. As the water level in the inner structural cell 19 rises, the lever-like section 25 of the floating device 23 rises. A downward flow of the fluid from an upper inner structural cell 19 to a neighboring lower inner structural cell 19 of the flexible fillable wall 3 continues until the lever-like section 25 of the floating device 23 within the controlled-access one-directional cell opening 21 seals the opening and stops the downward flow of the fluid into the neighboring lower inner structural cell 19. The lever-like section 25 of the floating device 23 is self-locked in that position and can only be manually unlocked by accessing the floating device 23 from outside. The lever-like section 25 of the floating device 23 is used to hold the flexible fillable wall 3 in an upright position and to prevent the upper portion 5 of the flexible fillable wall 3 from caving in. The flexible fillable wall 3 can be anchored down to the ground for additional support. A bottom grid 37 (shown in FIG. 3A), which has the ability to seal from below, may have foam-like porous material that can be positioned at the bottom end 11 of the flexible fillable wall 3.

In a preferred embodiment, the flexible fillable walls 3 are used as sides and as side walls 3' of portable flexible reservoirs 2 and surround a storage space 29R (refer to FIG. 2A) wherein any amount of fluid that surpasses the flexible fillable walls 3 is collected. (Please note that when used as a "reservoir", the invention is serving as a place where the fluid is collected and is kept in store for later use. However, the term "reservoir" is preferably intended to describe a barrier for a body of standing fluid. The portable flexible reservoir 2 does not have a base, with the earth serving as a base of the portable flexible reservoir 2, but has flexible fillable side walls 3' for the collected fluid. The fluid that flows into the earth soaks the earth to a degree that the earth does not absorb any more fluid and, thus, there is no further outflow of the fluid through the bottom of the portable flexible reservoir 2. The portable flexible reservoir 2 may optionally have a top surface 41 (not shown) attached to or positioned upon the side walls 3'. Top surfaces 41 may be used with portable flexible fillable barriers 1 for avoiding or minimizing the evaporation of the fluid and to prevent contamination of the collected fluid.) The portable flexible reservoirs 2 are made of interconnecting side walls 3' into various forms (e.g. quadrilateral, hexagonal, octagonal etc.). Multiple portable flexible reservoirs 2 can be connected together, preferably by sharing a side wall 3' with an adjacent unit, to contain and store larger volumes of fluid. In a preferred embodiment, the side walls 3' of the portable flexible reservoir 2 are in the form of a hexagon, with each side wall 3' of the portable flexible reservoir 2 being shared with a neighboring portable flexible reservoir 2 and, thus, the least amount of material being used to achieve a maximum capacity. When the portable flexible reservoir 2 shares a side wall 3' with the adjacent portable flexible reservoir 2, a hole 15 in the shared side wall 3' (preferably adjacent to the top end 9 of the shared side wall 3') allows the flow of fluid out of a storage space 29R formed by one portable flexible reservoir 2 into the storage space 29R formed by the adjacent portable flexible reservoir 2. (Please refer to FIG. 1A.) In another embodiment, portable flexible reservoirs 2 that do not share a side wall 3' are connected to one another by means of a tube 31. (Please refer to FIG. 2A.) Each tube 31 leads from one portable flexible reservoir 2 (i.e. "an outflow reservoir 2") to another portable flexible reservoir 2 (i.e. "an inflow reservoir 2"). In a preferred embodiment, the tube 31 connects an upper portion 5 of the side wall 3' of the outflow reservoir 2 to a lower portion 7 of the side wall 3' of the inflow reservoir 2. (Please refer to FIG. 2A.) The connections between portable flexible reservoirs 2 may be used as overflow conduits, said conduits serving as an exit for any fluid, in the storage space 29R, that reaches the level of the related connection. The overflow conduits include a flexible joint between portable flexible reservoirs 2 and are preferably formed of tubes 31 of adequate diameter to handle any projected overflow between storage spaces 29R.

The fluid is introduced into the portable flexible reservoirs 2 by various means. For example, the fluid may be pumped into the portable flexible reservoirs 2. The portable flexible reservoir 2 is used to contain and reserve the fluid. The internal pressures created by the fluids in the inner structural cells 19 of the side walls 3' force the side walls 3' outwards. If the portable flexible reservoirs 2 are sharing a side wall 3', adjacent portable flexible reservoirs 2 push against each other and conform with respect to the ground due to such outward forces. In addition to such outward forces, the connection of portable flexible reservoirs 2 that are sharing a side wall 3' is strengthened by attaching to ends of side walls 3' a fabric, such as hook and loop material or vinyl coated nylon, that can be fastened to itself. The fastener of each portable flexible reservoir 2 mates with a corresponding fastener of another adjacent portable flexible reservoir 2 such that adjacent portable flexible reservoirs 2 remain positioned next to each other.

Floods are avoided or alleviated by temporarily removing and storing rain water in portable flexible reservoirs 2 that are strategically positioned around the potential-flooding zone, such that the portable flexible reservoirs 2 receive any excess water until the rainfall decreases. The collected excess water can be temporarily stored and can, then, be safely emptied and dispersed of whenever and wherever desired. For example, water may be stored in the portable flexible reservoirs 2 for farming purposes. Thus, not only would the flood be avoided by quickly and inexpensively removing flood water, the excess amount of water that is collected may be used later. The portable flexible reservoirs 2 can be covered to avoid evaporation. Portable flexible reservoirs 2 may also be used for storing water that is not obtained from floods.

Figure 4:
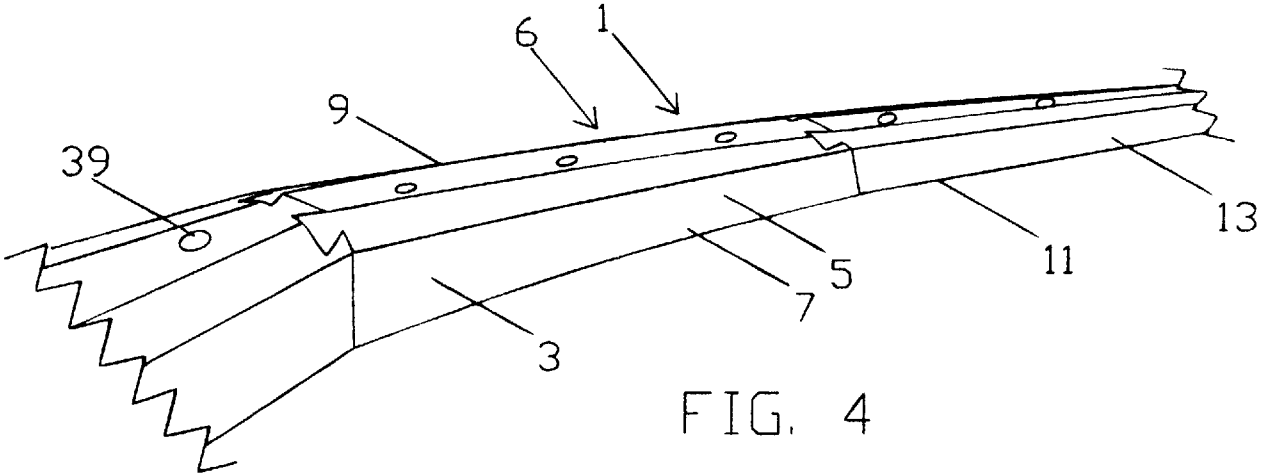
FIG. 4 shows a perspective view of a portable flexible fillable barrier that serves as embankments.

In addition, the flexible fillable wall 3 can be used to build a portable flexible embankment 6 for retaining or holding back the fluid, as shown in FIG. 4. (An "embankment" defines a raised structure, e.g. a wall, to hold back fluids. The term "embankment" refers to a portable flexible wall and is solely used here to avoid any confusion between the "portable flexible walls", i.e. "embankments 6", that are built of flexible fillable walls 3, and the "flexible fillable walls 3".) The portable flexible embankments 6 are made up of flexible fillable walls 3 that are preferably connected together on site. The flexible fillable walls 3 of the portable flexible embankments 6 may be sealed to one another at their connecting ends. When sealed to one another, the flexible fillable walls 3 take a permanent shape and are not collapsible any more. The portable flexible embankment 6 is flexible enough to follow the topography of the area of set-up. The upper portion 5, the lower portion 7 and the sides 13 of the flexible fillable walls 3 may each have a number of openings in flexible fillable walls 3 for the flowing of fluid into and out of the portable flexible embankments 6. Upon being assembled, the portable flexible embankments 6 can be anchored or tied down to the ground for additional support.

Figure 5B:
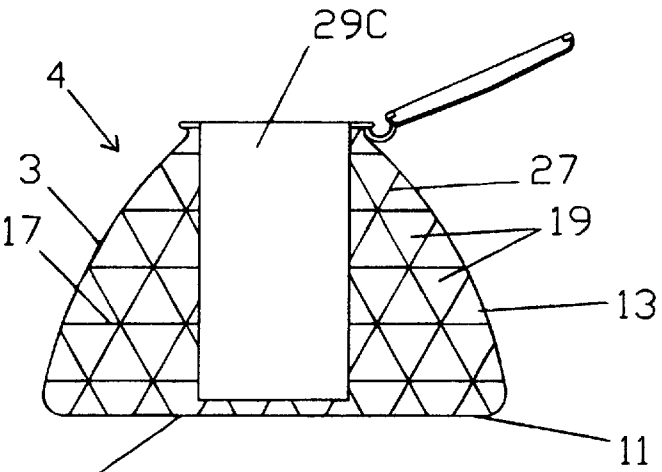
FIG. 5B shows a cross-sectional view of FIG. 5A, along line I—I in FIG. 5A.
Figure 5A:
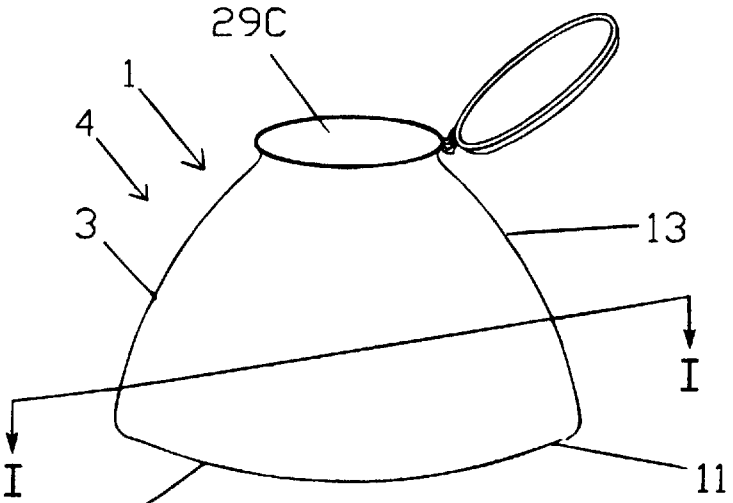
FIG. 5A shows a perspective view of a portable flexible fillable barrier that serves as a storage container.

The flexible fillable walls 3 can also be utilized, solely or in combination with other components, to build a portable, flexible, fluid storage container 4, as shown in FIGS. 5A and 5B. (Please note that, unlike a reservoir 2, a fluid storage container 4 includes a bottom surface 43, as shown in FIG. 5B. The bottom surface 43 of the fluid storage container 4 prevents a downward flow of the collected fluid out of the fluid storage container 4 via the bottom surface 43 of the fluid storage container 4. Thus, the fluid in the fluid storage container 4 only exits via any holes 15 (not shown in FIG. 5B) in the flexible fillable walls 3 of the fluid storage container 4.) The flexible fillable walls 3 of the fluid storage container 4 surround a storage space 29C wherein any amount of fluid that surpasses the flexible fillable walls 3 is collected. The fluid storage container 4 may have different shapes, with cubical, conical, dome-shaped and tubular shapes being some of the preferred embodiments. The flexible fillable walls 3 may each have an opening and closing apparatus for the flow of fluid into and out of the fluid storage container 4. Multiple fluid storage containers 4 can be assembled together to form a larger fluid storage container 4. The assembled fluid storage containers 4 can communicate by means of holes 15 close to the top end 9 of each shared side wall 3. In another embodiment, the assembled fluid storage containers 4, that are not sharing a side wall 3, can be connected to one another by means of a tube 31 that is attached to the upper portion 5 of one side wall 3' of the outflow fluid storage container 4 and to the lower portion 7 of one side wall 3' of the inflow fluid storage container 4. The assembled fluid storage containers 4 are filled by introducing fluid into at least one fluid storage container 4 by various means and methods, such as by using pumps to pump fluid into the fluid storage containers 4. The fluid that flows into and out of the storage space 29C of the fluid storage container 4 may be identical to or different from the fluid that flows into and out of the flexible fillable walls 3 of the fluid storage container 4.

Although portable flexible fillable barriers 1 are preferably used to contain flood water, portable flexible fillable barriers 1 can also be used for storing any other fluid. For example, portable flexible fillable barriers 1 can be used for collecting and storing fresh water from a well system or from city water. The portable flexible fillable barrier 1 can also serve as a fluid storage container 4 for liquid hazardous waste in the event of accidental leaks or ruptures in transport vehicles or storage devices. In addition, the portable flexible fillable barrier 1 can be used for crop storage, for drying bins and for any solids that can be contained and stored in structures utilizing flexible fillable walls 3.

Due to the simplicity of its utilization, the portable flexible fillable barrier 1 can be rapidly positioned to capture fluids and solids with minimal handling. Portable flexible fillable barriers 1 can be erected and connected together with minimal training. Therefore, the portable flexible fillable barrier 1 can be even thrown into the proper position to capture hazardous fluids during emergency conditions without requiring the individual to physically contact the fluid. Meanwhile, the portable flexible fillable barrier 1 can be discharged simply by releasing any number of openings 39 of the portable flexible fillable barrier 1. The portable flexible fillable barrier 1, due to its flexibility and lack of any rigid structural components, is collapsible on itself and can be collapsed into a small size for storage. In addition, the portable flexible fillable barrier 1 is self-opening from the collapsed state to the open rigid state. One person can assemble and disassemble a portable flexible fillable barrier 1 within a relatively short period of time. Whether in the filled or in the collapsed condition, portable flexible fillable barriers 1 can be stored together in a compact manner in small spaces without any wasted space. As a result, whether in the collapsed or in the filled condition, the portable flexible tillable barrier 1 can be effectively packaged, stored and transported.

An advantageous feature of the present invention is the novel design which permits any number of portable flexible fillable barriers 1 to be rapidly laid beside one another to form a structure of substantial rigidity of any desired length and width without the use of any fastening elements. There is some flexibility to the height of the structure as well. Although the height of the structure is limited by the maximal capacity of the portable flexible fillable barrier 1, the structure may have any height up to that maximal allowed. The height of the structure is automatically adjusted by the amount of fluid or solid that is contained in the portable flexible fillable barrier 1 at any time. Thus, the portable flexible fillable barriers 1 provide a highly effective means for constructing rigid barricades of a wide variety of shapes. In addition, it should be noted that, in a preferred embodiment, the portable flexible fillable barrier 1 does not have any angles formed by separable edges of adjacent flexible fillable walls 3 (i.e. which have to be attached, prior to or during filling up of the portable flexible fillable barrier 1, to form bends in the portable flexible fillable barrier 1). Rather angles are included within and as internal components of angled flexible fillable walls 3. The enclosed angles are applied in order to protect the flexible fillable walls 3 from rupturing, particularly when the portable flexible fillable barrier 1 is filled with fluid.

Different chemicals may be used for the flexible fillable walls 3, as long as the inner structural cells 19 are either hollow or are constructed from a foam-like porous material that provides the features required for a satisfactory performance of the inner structural cells 19.

The portable flexible fillable barrier 1 is relatively inexpensive since the man-hours of work needed for manufacturing, packaging, transporting and setting up the product are relatively negligible. Application of the portable flexible fillable barrier 1 reduces the cost associated with the labor and materials required in constructing a water barricade, dam or the like around a house, along a river bank, around a storage tank, adjacent to a food or other processing plant or the like. For example, if water is rising and moving toward a home, manufacturing facilities or other location from which water is to be excluded, the portable flexible fillable barrier 1 can be installed around that facility so that as water rises and engages the lowermost layer of inner structural cells 19, the water will be absorbed and the expandable material will expand in the lowermost layer of the inner structural cells 19 and as the water rises, succeeding higher sections of the inner structural cells 19 will expand. As a result, a barrier is being continuously formed around the facility and as the flood water rises, so does the barrier. Thus, the portable flexible fillable barrier 1 can be installed before the flood water reaches a particular location, with the inner structural cells 19 expanding automatically as flood water reaches the portable flexible fillable barrier 1. No matter what the shape of the portable flexible fillable barrier 1 is, it can be used on a surface of any shape, slope and form. The portable flexible fillable barrier 1 conforms in shape and slope to the shape and slope of whatever rigid or non-rigid surface that is disposed beneath the portable flexible fillable barrier 1. The bottom surface 43 of the portable flexible fillable barrier 1, when used as a storage container 4, takes the shape of the rigid or non-rigid surface that is disposed beneath the bottom surface 43. Therefore, the friction that develops between the bottom surface 43 of the portable flexible fillable barrier 1 and its underlying surface prevents the movement of the portable flexible fillable barrier 1.

The method of application of the portable flexible fillable barrier 1 is extremely simple, safe, time-saving and particularly helpful during emergency conditions. When needed, the portable flexible fillable barrier 1 is transported in a flattened condition, to a point of use. Except for assuring an appropriate positioning of the portable flexible fillable barrier 1, setting up the portable flexible fillable barrier 1 requires no special expertise and is not complicated, dangerous, time-consuming or energy-consuming. If the direction of flow of the fluid is known, the portable flexible fillable barrier 1 may even be applied by being simply thrown to the desired location.

The portable flexible fillable barrier 1 self-opens from the collapsed state to the open rigid state while fluid flows into and is collected within the flexible fillable walls 3. Whether the fluid is pumped into or is carried by a flood or by any other means into the portable flexible fillable barrier 1, the portable flexible fillable barrier 1 contains and reserves the fluid until the fluid is willingly removed. The fluid flows into the flexible fillable wall 3 from any number of openings 39 that open into the flexible fillable wall 3. The fluid that enters the flexible fillable wall 3, is trapped in and becomes an essential component of the inner structural cells 19 of the flexible fillable wall 3.

In a preferred embodiment, while the fluid is flowing into the flexible fillable wall 3, the top end 9 of the flexible fillable wall 3 is being pulled up automatically. Before any inner structural cell 19 is filled with fluid, the corresponding floating device 23 is positioned such that the controlled-access one-directional cell opening 21 is not closed and the fluid may flow into the inner structural cell 19. As the water level in the inner structural cell 19 rises, the lever-like section 25 of the floating device 23 rises. A downward flow of the fluid from any upper inner structural cell 19 to the neighboring lower inner structural cell 19 of the flexible fillable wall 3 continues until the lever-like section 25 of the floating device 23 within the controlled-access one-directional cell opening 21 seals the opening and stops the downward flow of the fluid into the neighboring lower inner structural cell 19. In order to minimize any leakage of fluids from the flexible fillable walls 3, safety measures may be taken in the inner structural cells 19 along outer exposed sides 13 of the flexible fillable wall 3. For safety measures, in the inner structural cells 19 along the outer exposed side 13 of the flexible fillable wall 3, when the lever-like section 25 of the floating device 23 within the controlled-access one-directional cell opening 21 seals the opening and stops the flow of fluid into the inner structural cell 19, the lever-like section 25 of the floating device 23 is self-locked in that position and can only be manually unlocked by accessing the lever-like section 25 of the floating device 23 from outside. The floating device 23 holds the flexible fillable wall 3 in an upright position and prevents the upper portion 5 of the flexible fillable wall 3 from caving in. There may be a controlled inflow and outflow of the enclosed fluid between inner structural cells 19. However, the enclosing flexible membrane 27 prevents any flow of the enclosed fluid, via the impermeable material, out of the inner structural cells 19.

The internal pressures created by the fluids in the inner structural cells 19 of the flexible fillable walls 3 force the flexible fillable walls 3 outwards. For example, finger-like interconnecting edges 35A,35B of adjacent flexible fillable walls 3 of the portable flexible fillable barrier 1 undergo a three-dimensional expansion as the fluid is filling up the flexible fillable walls 3. As a result, an increasingly stronger attachment forms between the neighboring flexible fillable walls 3 while the fluid is filling up the flexible fillable walls 3. In addition, outward forces within any sides 13 shared by two adjacent portable flexible fillable barriers 1 cause the adjacent portable flexible fillable barriers 1 to push against each other and to conform with respect to the ground.

Upon absorbing the fluid, the flexible fillable wall 3 expands to enable the portable flexible fillable barrier 1 to prevent the flow of the fluid. As the flexible fillable walls 3 of the portable flexible fillable barrier 1 expand and rise, the portable flexible fillable barrier 1 retains a higher level of fluid and has an increasing efficiency of performance. For portable flexible reservoirs 2 and fluid storage containers 4, while the flexible fillable walls 3 expand and rise, the space that forms among and is surrounded by the flexible fillable walls 3 serves as the storage space 29R, 29C for the fluids to enter. While the flexible fillable walls 3 rise, any amount of fluid that surpasses the height of the flexible fillable walls 3 enters the storage space 29R, 29C. As long as the fluid reaches above the flexible fillable wall 3, the fluid flows into the storage space 29R, 29C. When the storage space 29R, 29C is filled up, the fluid overflows and leaves the portable flexible fillable barrier 1. A following portable flexible fillable barrier 1, whether attached to the original portable flexible fillable barrier 1 or not, may be used to collect the overflown fluid. If the portable flexible fillable barriers 1 are attached to one another, the fluid simply flows from one storage space 29R, 29C into the storage space 29R, 29C of the following portable flexible fillable barrier 1 until each storage space 29R, 29C of all attached portable flexible fillable barriers 1 are filled up. If adjacent portable flexible fillable barriers 1 share a fluid path formed by holes 15, both outgoing and incoming, that are closer to the bottom end 11 of the flexible fillable wall 3 of each portable flexible fillable barrier 1, the fluid flows to the storage space 29C, 29R of all attached portable flexible fillable barriers 1 that have empty space available, with the fluid rising simultaneously within the storage space 29C, 29R of all attached portable flexible fillable barriers 1. If the holes 15, both outgoing and incoming, are positioned closer to the top end 9 of the flexible fillable wall 3 of each portable flexible fillable barrier 1, the fluid fills up the frontmost unfilled portable flexible fillable barrier 1 before moving to the next portable flexible fillable barrier 1. When the outgoing holes 15 are positioned adjacent to the top end 9 of the flexible fillable wall 3 of the portable flexible fillable barrier 1 and the incoming holes 15 are positioned adjacent to the bottom end 11 of the flexible fillable wall 3 of the portable flexible fillable barrier 1, the final portable flexible fillable barrier 1 is the last to be filled. If the incoming holes 15 are positioned adjacent to the top end 9 of the flexible fillable wall 3 of the portable flexible fillable barrier 1 and the outgoing holes 15 are positioned adjacent to the bottom end 11 of the flexible fillable wall 3 of the portable flexible fillable barrier 1, some force or positioning is needed to assure that the last unfilled portable flexible fillable barrier 1 is filled first.

When the flexible fillable walls 3, by absorbing the fluid inside the flexible fillable walls 3 and in some cases by collecting the fluid in the surrounded storage space 29C, 29R, are capable of stopping the flow of the fluid, there is no need to add any more portable flexible fillable barriers 1. Whenever desired, any fluid in the storage space 29C, 29R and/or in the flexible fillable wall 3 may be emptied. The portable flexible fillable barrier 1 can be discharged simply by opening any number of closed openings 39 of the flexible fillable walls 3 and any closed holes 15 in the sides 13. The collapsible flexible fillable walls 3 are, then, folded and transported to be stored for a following application.

Certain objects are set forth above and made apparent from the foregoing description, drawings and examples. However, since certain changes may be made in the above description, drawings and examples without departing from the scope of the invention, it is intended that all matters contained in the foregoing description, drawings and examples shall be interpreted as illustrative only of the principles of the invention and not in a limiting sense. With respect to the above description and examples then, it is to be realized that any descriptions, drawings and examples deemed readily apparent and obvious to one skilled in the art and all equivalent relationships to those stated in the examples and described in the specification or illustrated in the drawings are intended to be encompassed by the present invention.

Further, since numerous modifications and changes will readily occur to those skilled in the art, it is not desired to limit the invention to the exact construction and operation shown and described, and accordingly, all suitable modifications and equivalents may be resorted to, falling within the scope of the invention. It is also to be understood that the following claims are intended to cover all of the generic and specific features of the invention herein described, and all statements of the scope of the invention which, as a matter of language, might be said to fall in between.

What is claimed as invention is:

1. A reusable portable flexible fillable barrier having flexible fillable walls that are connected to one another and that each comprise:

(a) an upper portion;

(b) a lower portion;

(c) a top end;

(d) a bottom end;

(e) several sides;

(f) a number of openings in the one or more sides; and (g) a supporting frame comprising:

i. interconnected inner structural cells that comprise cell openings, and ii. an enclosing flexible membrane that encloses the inner structural cells;

such that a fluid enters the flexible fillable wall and the inner structural cells through the number of openings in the flexible fillable wall wherein the fluid is enclosed.

2. The portable flexible fillable barrier according to claim 1, wherein adjacent portable flexible fillable barriers share one side which includes the number of openings.

3. The portable flexible fillable barrier according to claim 1, wherein numerous portable flexible fillable barriers are attached to one another by tubes leading from and connecting one portable flexible fillable barrier to another.

4. The portable flexible fillable barrier according to claim 1, wherein finger-like interconnecting edges positioned on two opposite sides of each flexible fillable wall are complementary to one another and wherein the finger-like interconnecting edges on one side of one flexible fillable wall fit into and interlock with the complementary finger-like interconnecting edges on the opposite side of a neighboring flexible fillable wall; and such that when fluid is filling up said neighboring flexible fillable walls, the adjacent finger-like interconnecting edges are undergoing a three-dimensional expansion, resulting in an increasingly stronger attachment between the neighboring flexible fillable walls.

5. The portable flexible fillable barrier according to claim 4, wherein the number of openings that are in the sides allow flow of fluid into the flexible fillable walls.

6. The portable flexible fillable barrier according to claim 1, wherein the inner structural cells are in a pyramidal, cubical, spherical or geodesic shape.

7. The portable flexible fillable barrier according to claim 1, wherein the inner structural cells are hollow.

8. The portable flexible fillable barrier according to claim 1, wherein the inner structural cells of the flexible fillable walls are in a tubular form and are positioned either horizontally or normally to ground.

9. The portable flexible fillable barrier according to claim 1, wherein the inner structural cells are in a planar form and are positioned normally and long-ways to ground.

10. The portable flexible fillable barrier according to claim 1, wherein a coating, applied to the inner structural cells, serves as the enclosing flexible membrane.

11. The portable flexible fillable barrier according to claim 1, wherein, except for an uppermost and a lowermost group of inner structural cells, each cell opening is equipped with a floating device, is controlled-access and one-directional and is positioned in a bottom part of an upper inner structural cell and in a top part of a neighboring lower inner structural cell;

such that a downward flow of the fluid from each upper inner structural cell to a neighboring lower inner structural cell of the flexible fillable walls continues until the floating device within the control-access one-directional cell opening seals the cell opening and stops the downward flow of the fluid into the neighboring lower inner structural cell.

12. The portable flexible fillable barrier according to claim 11, wherein the floating device comprises a lever-like section and is attached to the inner structural cells.

13. The portable flexible fillable barrier according to claim 1, wherein a bottom grid is positioned at the bottom end of the flexible fillable wall.

14. The portable flexible fillable barrier according to claim 1, wherein caps are used for temporarily closing any desired number of openings of the flexible fillable walls.

15. The portable flexible fillable barrier according to claim 1, wherein, with the flexible fillable walls surrounding a storage space, the portable flexible fillable barrier serves as a portable flexible reservoir.

16. The portable flexible fillable barrier according to claim 15, wherein the flexible fillable walls have holes which allow flow of fluid in and out of each storage space.

17. The portable flexible fillable barrier according to claim 1, wherein, with the flexible fillable walls surrounding a storage space, the portable flexible fillable barrier serves as a portable, flexible, fluid storage container that comprises, in addition, a bottom surface.

18. The portable flexible fillable barrier according to claim 1, wherein the portable flexible fillable barrier, with its flexible fillable walls, serves as a portable flexible embankment for holding back the fluid, with numerous embankments being connected together for providing additional protection.

19. The portable flexible fillable barrier according to claim 18, wherein the portable flexible embankments, upon being assembled, are anchored to the ground for additional support.

20. The portable flexible fillable barrier according to claim 1, wherein the inner structural cells consist of foam-like porous material.

21. A method of applying reusable portable flexible fillable barriers each having flexible fillable walls that are connected to one another and that each comprises an upper portion, a lower portion, a top end, a bottom end, several sides, a number of openings in the one or more sides and a supporting frame that has (i) interconnected inner structural cells that comprise controlled-access one-directional openings each equipped with a floating device and (ii) an enclosing flexible membrane that encloses the inner structural cells, said method comprising:

(a) transporting the portable flexible fillable barriers in a flattened condition to a location where the portable flexible fillable barriers are to be used to prevent fluid flow from setting up the portable flexible fillable barriers at that location, such that the fluid flows, via the number of openings, into and is collected within the flexible fillable walls that are opening from collapsed states to open rigid states and are expanding in volume, such that a downward flow of the fluid from each upper inner structural cell to a neighboring lower inner structural cell of the flexible fillable walls continues until the floating device within the controlled-access one-directional opening seals the opening and stops the downward flow of the fluid into the neighboring lower inner structural cell, and such that the enclosing flexible membrane prevents any flow of the enclosed fluid out of the inner structural cells; and (b) collecting an amount of fluid in portable flexible fillable barriers which are transportable to and storable at any desired location.

22. The method of application of the portable flexible fillable barrier according to claim 21, wherein the movement of the fluid is restricted within the flexible fillable walls, which consist of foam-like porous material, and the fluid is only allowed to seep out of the inner structural cell if there is a cut or a relatively small damage in the enclosing flexible membrane.

23. The method of application of the portable flexible fillable barrier according to claim 21, wherein the portable flexible fillable barrier serves as a portable flexible reservoir or as a portable fluid storage container, such that while the flexible fillable walls expand and rise, the space that forms among and is surrounded by the flexible fillable walls serves as a storage space and any amount of fluid that surpasses the height of the flexible fillable walls enters the storage space.

* * * * *